US005988519A

United States Patent [19]

Jordie

[11] Patent Number: 5,988,519

[45] Date of Patent: Nov. 23, 1999

[54] PRECAST CONCRETE CURVED GRADE CROSSING WITH RESTRAINING RAIL

[75] Inventor: James J. Jordie, La Center, Wash.

[73] Assignee: Pacific International Pipe Enterprises, Inc., Portland, Oreg.

[21] Appl. No.: 08/972,798

[22] Filed: Nov. 18, 1997

[51] Int. Cl.[6] ..... E01B 5/00

[52] U.S. Cl. ..... 238/15; 238/2; 238/5

[58] Field of Search ..... 238/2, 3, 5, 7, 238/9, 15, 17, 21, 22, 315, 342, 351

[56] References Cited

U.S. PATENT DOCUMENTS

| | | | |
|---|---|---|---|
| 846,901 | 3/1907 | Bossert | 238/154 |
| 1,170,264 | 2/1916 | Hrnich | 238/17 |
| 1,467,842 | 9/1923 | Daley et al. | 238/8 |
| 1,725,410 | 8/1929 | Muchnic | 238/8 |
| 1,912,429 | 6/1933 | Burgess | 404/40 |
| 2,835,451 | 5/1958 | Goulding, Jr. | 238/8 |
| 3,317,137 | 5/1967 | Harmon | 238/8 |
| 3,469,783 | 9/1969 | Uralli et al. | 238/8 |
| 3,938,776 | 2/1976 | Frazier | 249/114 |
| 3,955,761 | 5/1976 | Szarka et al. | 238/2 |
| 4,210,281 | 7/1980 | Fee | 238/327 |
| 4,232,822 | 11/1980 | Hahn et al. | 238/7 |
| 4,236,670 | 12/1980 | Lemmergard et al. | 238/8 |
| 4,449,666 | 5/1984 | Hales et al. | 238/84 |
| 4,606,498 | 8/1986 | Grant et al. | 238/8 |
| 4,641,779 | 2/1987 | O'Brien et al. | 238/7 |
| 4,793,545 | 12/1988 | Raymond | 238/8 |
| 4,860,952 | 8/1989 | Schmidt | 238/8 |
| 4,899,933 | 2/1990 | Martin | 238/8 |
| 5,181,657 | 1/1993 | Davis | 238/2 |
| 5,464,152 | 11/1995 | Wabnitz | 238/8 |
| 5,626,289 | 5/1997 | Demers, Jr. | 238/8 |

FOREIGN PATENT DOCUMENTS

| | | | |
|---|---|---|---|
| 4221106 | 8/1992 | Japan | 238/8 |
| 5202501 | 8/1993 | Japan | 238/382 |
| 770824 | 3/1957 | United Kingdom | 238/8 |
| 8608428 | 11/1986 | WIPO | 238/8 |

*Primary Examiner*—Robert J. Oberleitner
*Assistant Examiner*—Robert J. McCarry, Jr.
*Attorney, Agent, or Firm*—Marger Johnson & McCollom, P.C.

[57] ABSTRACT

A precast concrete curved grade crossing includes a plurality of base members, each of which has a central recess formed in the upper surface thereof. The central recess receives a plurality of center panels. The plurality of base members and center panels are laid end-to-end to form a curved crossing. Each of the plurality of base members and center panels have a substantially trapezoidal shape which varies in dimension proportional to the radius of curvature of the crossing. A restraining rail is removably attached to a first standard rail, both being received between the base members and center panels to add rigidity and structural stability. The first standard rail together with the restraining rail are encased by a wide rubber boot which extends through the crossing in a single continuous piece to maintain electrical isolation between the concrete base member and center panels and the first and restraining rails. A second standard rail is laid substantially parallel to the first rail to form the pair of railroad tracks. The second standard rail is encased by a rubber boot which also extends through the crossing in a single continuous piece.

21 Claims, 3 Drawing Sheets

PRECAST CONCRETE CURVED GRADE CROSSING WITH RESTRAINING RAIL

BACKGROUND OF THE INVENTION

1. Field of Invention

The present invention relates generally to railroad crossings having precast concrete panels and methods for making such crossings and, more particularly, to such crossings which are curved and include a restraining rail cast into place to restrict the lateral movement of train or railcar wheels as the train travels through the crossing.

2. Brief Description of the Prior Art

When a roadway crosses railroad tracks, a crossing must be constructed to permit traffic to pass over the tracks as smoothly as possible. Typically, the top surfaces of each of the tracks are in substantially the same plane as the roadway on either side of the tracks. A recessed area between the tracks and to either side thereof are built up to street level with the exception that recesses must be provided adjacent the upper portion of each track to accommodate the flanges on railcar wheels.

Timber, asphalt, and poured concrete are examples of prior art materials which have been used to construct railroad crossings. Frequently, maintenance must be performed on these railroad crossings. This may be occasioned by the resurfacing of the street, the need to remove or replace the rails, or the settling of the rail bed. With these types of railroad crossings such maintenance can be extremely expensive and labor intensive.

Precast concrete crossings avoid some of these difficulties by using a plurality of modular concrete sections to form the railroad crossing. One type of prior art precast concrete crossing includes precast structures which are received under the railroad track in the crossing and which substitute for the railroad ties that support the track on either side of the crossing. Another type of precast concrete crossing includes precast structures which are supported on ties in the crossing adjacent railroad track which is also supported on the ties.

One example of the latter type of precast concrete crossing is disclosed in U.S. Pat. No. 5,191,657 to Davis for a composite rubber/concrete railroad grade crossing system. In Davis, substantially rectangular precast panels have a metal corner portion made of angle iron, cast into the panel around the upper perimeter thereof. Elastomeric pad units abut either side of each rail with a plurality of central precast concrete panels laid end to end in the center and narrower precast concrete panels laid end to end on the outer sides of each track. The panels thus hold the elastomeric portion in place and are, in turn, restrained from longitudinal movement along the tracks by brackets which are bolted to the ties and which abut the panels at each end of the crossing.

The metal corner portions are provided to prevent the concrete corners from crumbling as a result of traffic passing thereover. In some prior art installations using similar panels, the metal corner portions on adjacent panels are welded together to prevent independent movement of separate panels.

Precast panels for use in grade crossings such as those shown in the Davis patent are created using a rectangular mold. A rectangular angle iron frame is placed on an upper portion of the mold. Thereafter concrete is placed in the mold to the level of the top surface of the frame thereby casting the metal frame into the upper surface of the panel.

Another example of a precast concrete crossing is disclosed in U.S. Pat. No. 4,641,779 to O'Brien et al., for a concrete grade crossing system. In O'Brien, a modular railway crossing structure supports a pair of rails. The rail bed unit in O'Brien comprises a bed member which is wider than the track, and two opposed center panels which are mirror images of one another. The base member has a central recess which is approximately as deep as standard rail and the walls of the recess are shaped to conform generally to the rail. The width of the central recess corresponds to the desired gauge of the railway. The two center panels are designed to fill the remainder of the central recess in the base member and are placed in abutting relation in the recess. The outer edge of each member conforms to the profile of the rail in like manner to the walls of the recess in the base member. These central units are bolted in place to the base member to form a railroad crossing bed unit. A complete railway crossing is constructed by placing a plurality of such units in abutting end-to-end relation. The base member and center panels are manufactured using two rectangular forms. Concrete is poured into these rectangular forms to mold the bed unit and the center panels.

Problems exist with both types of precast concrete crossings. The metal corner portions disclosed in the Davis patent creates a conductor capable of shunting currents between the rails which can create signalization malfunctions. Such prior art panels include opposing metal corner portions which are each within a few inches of an adjacent rail. In the presence of salt and water, specially in freezing temperatures, a conductive path between the rails is easily set up whether or not the corner portions are welded to one another.

The welds in the Davis patent are also problematic when maintenance is required on the railroad bed in the crossing. This requires that the panels be removed, which in turn, requires breaking the welds on any of the panels that are welded together. After maintenance of the bed, the panels are returned to the crossing re-welded.

Additionally problems arise when the crossing is curved. Both Davis and O'Brien provide for rectangular precast concrete panels, each piece molded to have identical dimensions. Rectangular shaped panels are not appropriate for use in curved crossings because they do not fit tightly together when laid end-to-end on a curve leaving wide gaps between panels. An improvement has been to use wedge-shaped panels having identical dimensions instead of rectangular panels to form curved crossings. When wedge-shaped panels are laid end-to-end to form curved crossings, facing in between adjacent panels results because the dimensions of the panels are not varied in proportion to the radius of curvature of the crossing curve. Facing between adjacent wedge-shaped panels reduces the durability of the crossing.

Curved crossings present yet another problem. When a railroad car moves across a curved area, the train or railcar wheels which travel on the inside curve rail is pulled towards the outside of the curve due to the centrifugal forces acting on the train or railcar. These forces cause the train or railcar wheels traveling on the inside curve rail to exert additional forces on the center panels which limit the life of the crossing.

Even further problems arise when curved crossings are poured in place. For example, the roadway is out of service longer than if precast panels are used because of the time required to dry the concrete crossing. The quality of crossings poured in place is more difficult to control than that of panels precast in a controlled environment. Thus, curved crossings that are poured have reduced durability and exhibit higher wear. Installation of such crossings creates serious traffic disruptions. Also, quality for poured crossings varies.

Also discussed in the O'Brien patent is the use of an elastomeric boot in connection with a precast concrete crossing. In the O'Brien system, the boot entirely encases the flange or lower portion of each rail. The boot extends from the flange along each side of the rail and terminates on both sides of the rail, at a point just beneath the head or upper portion of the rail upon which a train wheel is supported. While the boot disclosed in the O'Brien patent works well to cushion the rail against abrasion and vibration, because the entire head of the rail is exposed, there may be electrical conductivity between the rail and the precast concrete in which it is secured. This condition is aggravated in regions where salt is applied to roads in snowy and icy weather by increasing the conductivity of water accumulating on the crossing. When the rail is not electrically isolated, it cannot be effectively used as a signal conductor. In addition, current flowing between the rail and the concrete accelerates corrosion. When the O'Brien system is used, access to the rails can be had by removing the central panels. This permits repair and replacement of the boot. It would be desirable to provide such access on a curved crossing.

It would also be desirable to provide a precast concrete panel for use in grade crossing on a roadway which overcomes problems associated with prior art crossings.

It would also be desirable to provide such a crossing which can be easily removed and replaced for maintenance to the rail bed beneath the crossing.

It would also be desirable to provide such a crossing which reduces signalization problems.

It would also be desirable to provide such panels for use in curved crossings which eliminates facing between adjacent panels.

It would also be desirable to provide such panels with increased durability.

It would also be desirable to provide such panels with a restraining rail coupled to the standard rail to provide increased rigidity.

It would also be desirable to provide such panels with a restraining rail coupled to the standard rail to restrict the movement of train or railcar wheels as they travel through the crossing.

It would also be desirable to provide such a crossing in which an elastomeric boot is used to provide electrical isolation.

It would also be desirable to provide such a crossing in which the boot is easily maintained and replaced.

It would also be desirable to provide such a crossing which minimizes road disruption.

It would also be desirable to provide a method for making such a panel.

It would also be desirable to provide a method for making a curved crossing with a high degree of quality control.

It would also be desirable to provide a method for making such panels that would minimize process variations from panel to panel.

SUMMARY OF THE INVENTION

The present invention provides a new precast concrete curved grade crossing with a restraining rail and a method for making such a crossing.

The curved grade crossing of the present invention includes a precast concrete base member formed with a central recess, said central recess having a first and second parallel walls formed to conform generally to an outer surface of a rail. A first and a second precast concrete panels are laid substantially abutting at first ends of each of first and second panels and substantially received within the central recess of said base member. The first and second panels form a first recess between the first parallel wall of said base member and a second end of said first panel and also form a second recess between the second parallel wall of said base member and a second end of said second panel. A first rail and a restraining rail is substantially received within the first recess. The restraining rail is laid adjacent to said first rail. Finally, a second rail substantially received within the second recess and laid substantially parallel to said first rail.

The curved grade crossing of the present invention also includes a first boot encasing said first and restraining rails by covering substantially an outer surface of said first and restraining rails.

The grade crossing of the present invention is curved and includes a base member and first and second panels which together have a substantially trapezoidal shape which varies according to a radius of curvature of the crossing.

The foregoing and other objects, features, and advantages of the invention will become more readily apparent from the following detailed description of a preferred embodiment which proceeds with reference to the drawings.

DETAILED DESCRIPTION OF THE PREFERRED EMBODIMENT

Figure 1:
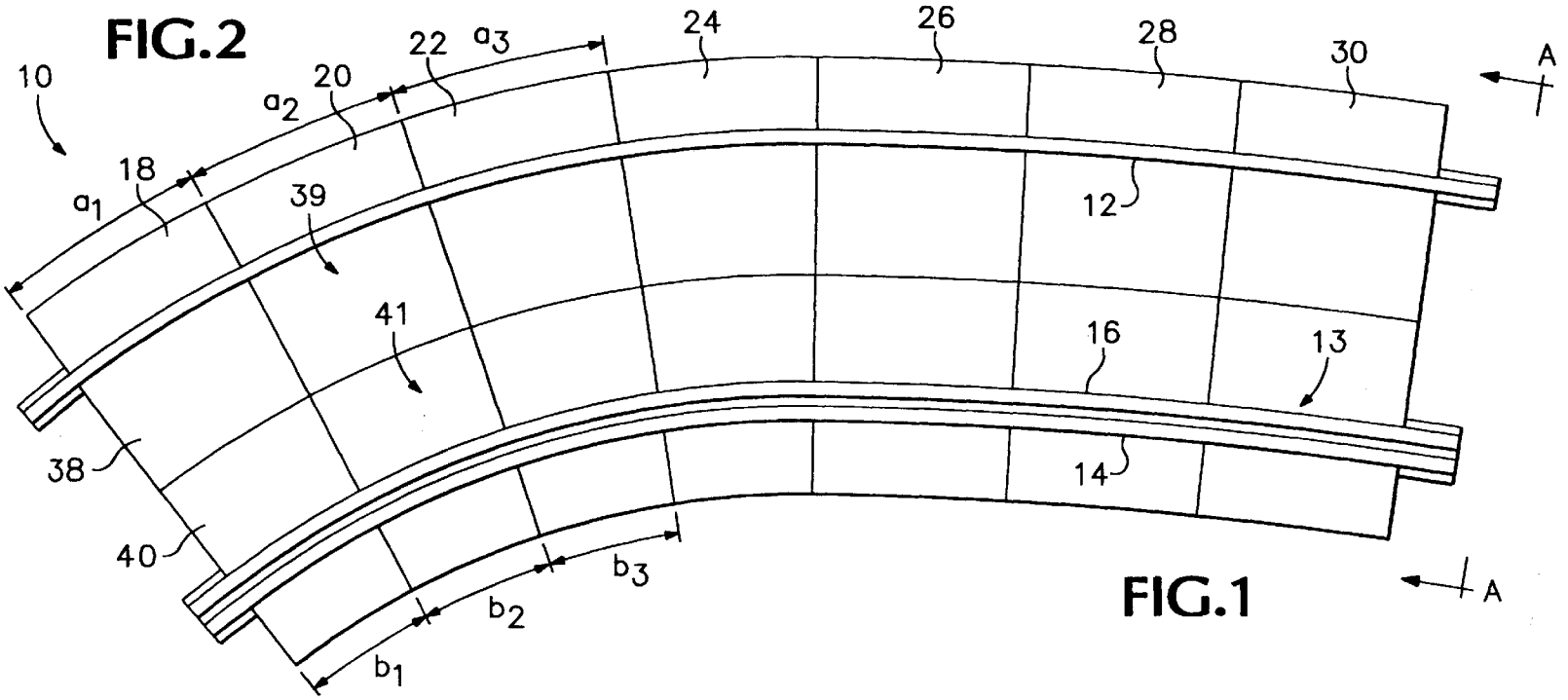
FIG. 1 is a plan view of a precast concrete curved grade crossing constructed in accordance with the present invention.

Referring now to the drawings, indicated generally at 10 in FIG. 1 is a grade crossing for rail 12 and rail pair 13 which forms a railroad track. Crossing 10 includes a plurality of precast concrete base members 18, 20, 22, 24, 26, 28, and 30 laid end-to-end. Each base member, like base member 18, includes a central recess having a floor 32 and a pair of opposed parallel walls 34 and 36, both shown in FIG. 2. Opposed parallel walls 34 and 36 are molded to conform to the profile of railroad rails 12 and 14. First and second precast concrete center panels 38 and 40, respectively, are supported by floor 32 within the central recess and are typically bolted to base member 18. First concrete center panels 38 has a parallel wall 35 which is molded to conform to the profile of restraining rail 16 and clip 80. Second concrete center panel 40 has a parallel wall 37 which is molded to conform to the profile of rail 12 and simple boot flange 58.

As can be seen in FIG. 1, base members 18, 20, 22, 24, 26, 28, and 30 and their respective center panels, like center panels 38, 39, 40, and 41, are laid end-to-end to form a curved crossing. Base members 18, 20, 22, 24, 26, 28, and 30 each have a substantially trapezoidal shape. However, each base member and its corresponding central panels have dimensions which vary in proportion to the radius of curvature of the crossing in which they are laid. For example, base member 18 has a trapezoidal shape defined in part by dimensions a1 and b1, where dimension a1 is slightly longer than dimension b1 as shown in FIG. 1. Similarly, base member 20 has a trapezoidal shape defined in part by dimensions a2 and b2, where dimension a2 is slightly longer than dimension b2. In order to ensure a tight fit between base member 18 and base member 20 when both members are laid next to each other to form a curved crossing, dimensions a1, a2, b1, and b2 will vary in proportion to the curve. That is, the ratio of dimensions a1 to b1 might be different than the ratio of dimensions a2 to b2 depending on the location of base member 18 and 20 along the curve crossing. By varying the dimensions of each of the panels in relation to the radius of curvature of the curved crossing, spacing can be eliminated between panels even when the radius of curvature is severe. A person having ordinary skill in the art to which the present invention relates can specify suitable dimensions for base members and central panels laid to form a curved crossing, like base members 18 and 20 and central panels 38, 39, 40, and 41, such that facing is eliminated between adjoining members as shown in FIG. 1.

Prior art concrete grade crossing systems are disclosed in U.S. Pat. No. 5,626,289 to Demers, Jr., et al. and in U.S. Pat. No. 4,641,779 to O'Brien, et al., which are incorporated herein by reference.

Figure 2:
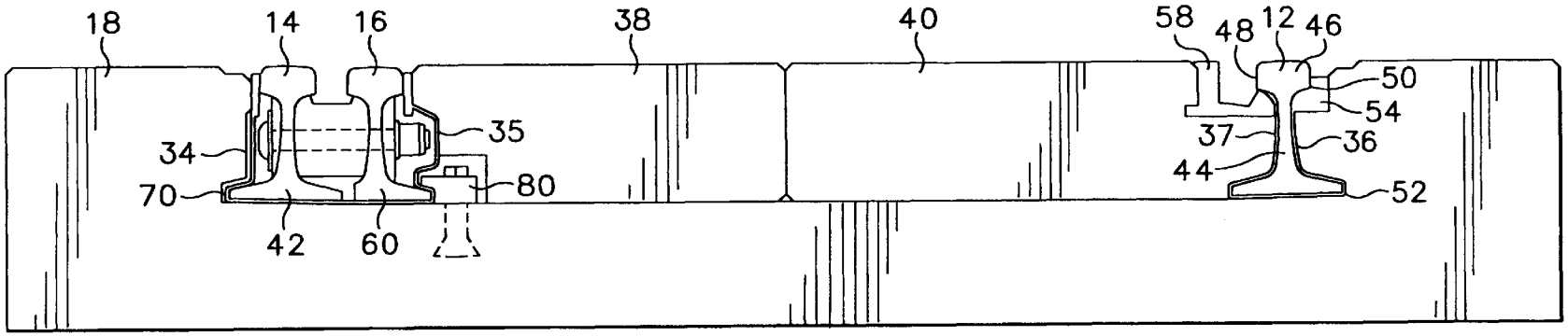
FIG. 2 is an sectional side view along line A—A of FIG. 1.

With reference to FIG. 2, rails 12 and 14 include a base portion 42, a web portion 44, and a head portion 46. Rails 12 and 14 include an inner surface 48 which comprises respectively that side of rail 12 which is directed toward second concrete panel 40 and that side of rail 14 which is directed toward restraining rail 16. Rails 12 and 14 also include an outer surface 50 comprising that side of rails 12 and 14 directed toward base member wall 34 and 36, respectively.

Figure 3:
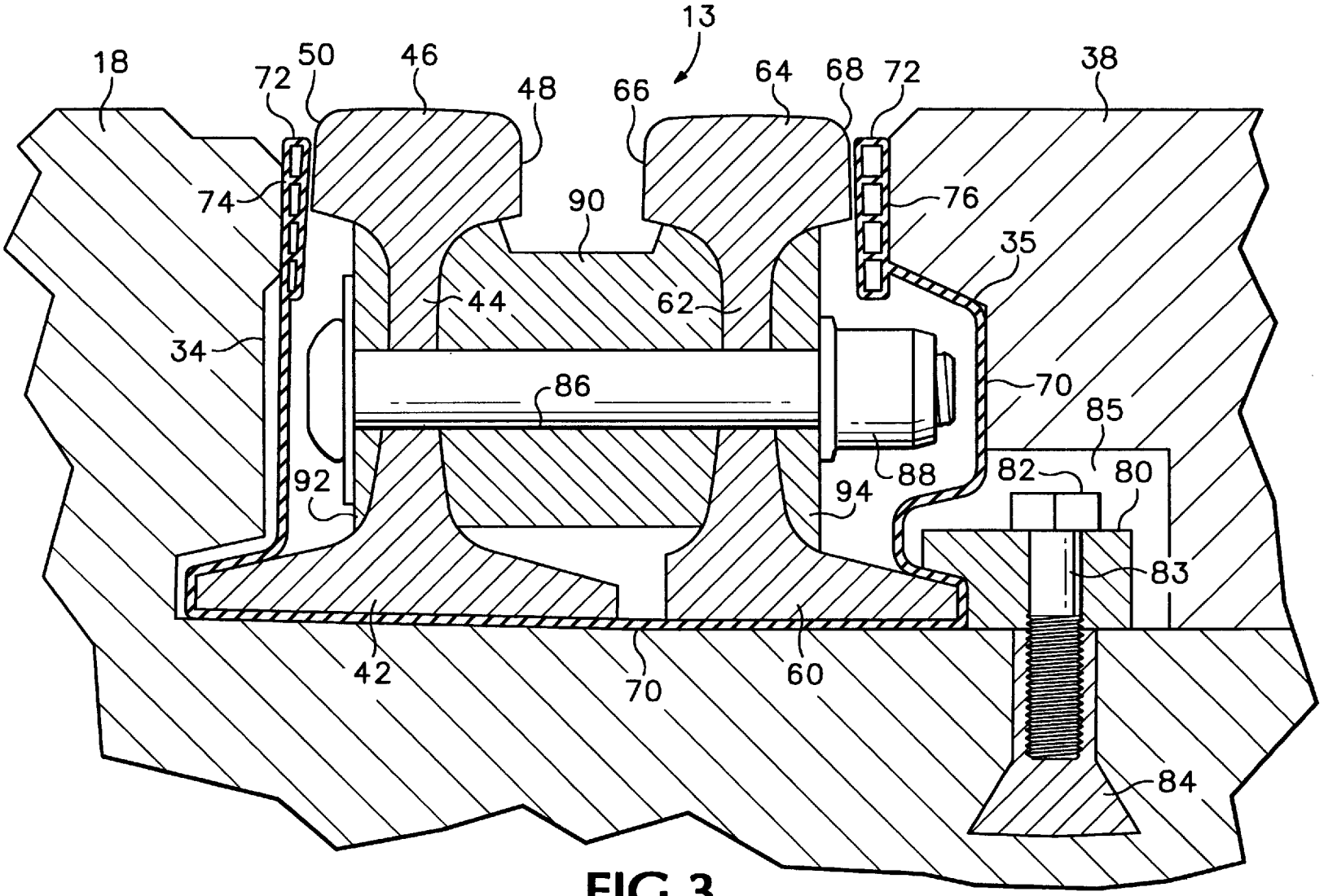
FIG. 3 is an enlarged view of a portion of FIG. 2.

A wide elastomeric boot 70 encases rail pair 13 as shown enlarged in FIG. 3. Wide boot 70 includes a first ribbed portion 74 which extends upwardly along outer surface 50 of rail 14 to substantially cover the outer side of rail head 46. Similarly, wide boot 70 includes a second ribbed portion 76 which extends upwardly along outer surface 68 of restraining rail 16 to substantially cover the outer side of restraining rail head 64. First and second ribbed portions 74 and 76 provide a cushioned electrically isolating layer between rail 12 and restraining rail 16 which keep the concrete of base member 18 and center panel 38 from coming into contact with rail head 46 and restraining rail head 64. First and second ribbed portions 74 and 76, respectively, also prevent water from entering the space between wide boot 70 and walls 34 and 35 of base member 18 and center panel 38, respectively.

Referring now to FIG. 2, a simple elastomeric boot 52 encases rail 12. Simple boot 52 includes a lip 54 which extends upwardly along outer surface 50 of rail 12 to substantially cover the outer side of rail head 46. A shoulder (not shown) on base member 18 forces boot lip 54 into sealing engagement with outer surface 50 of rail head 46. This prevents water from entering the space between the boot and parallel wall 56 to thereby electrically insulate rail 12 from the precast concrete base member 18 or center panel 40. Also, since the panels are precast and not poured in place, wide boot 70 and simple boot 52 are easily accessible for replacement and maintenance. Wide boot 70 and simple boot 52 can be reached by simply lifting center panels 38 and 40.

Boot flange 58 is received in a channel formed in panel 40 as shown in FIG. 2. Boot flange 58 is made up of the same material as simple boot 52 and seals against the underside of rail head 46 thus preventing water from entering the space between simple boot 52 and rail 12 on the inner side thereof.

Simple boot 52 and wide boot 70 can be made of an EPDM or a thermoplastic material which has an appropriate resilience for limiting vibration and which is sufficiently tough to prevent abrasion of the concrete by the rails 12 and 14 and restraining rail 16. In addition, simple boot 52 and wide boot 70 must have a sufficient resistivity, both when dry and when exposed to water which may have salt, to electrically isolate rail 12 and rail pair 13. A person having ordinary skill in the art to which the present invention relates can specify a suitable material to form simple boot 52 or wide boot 70.

Figure 4:
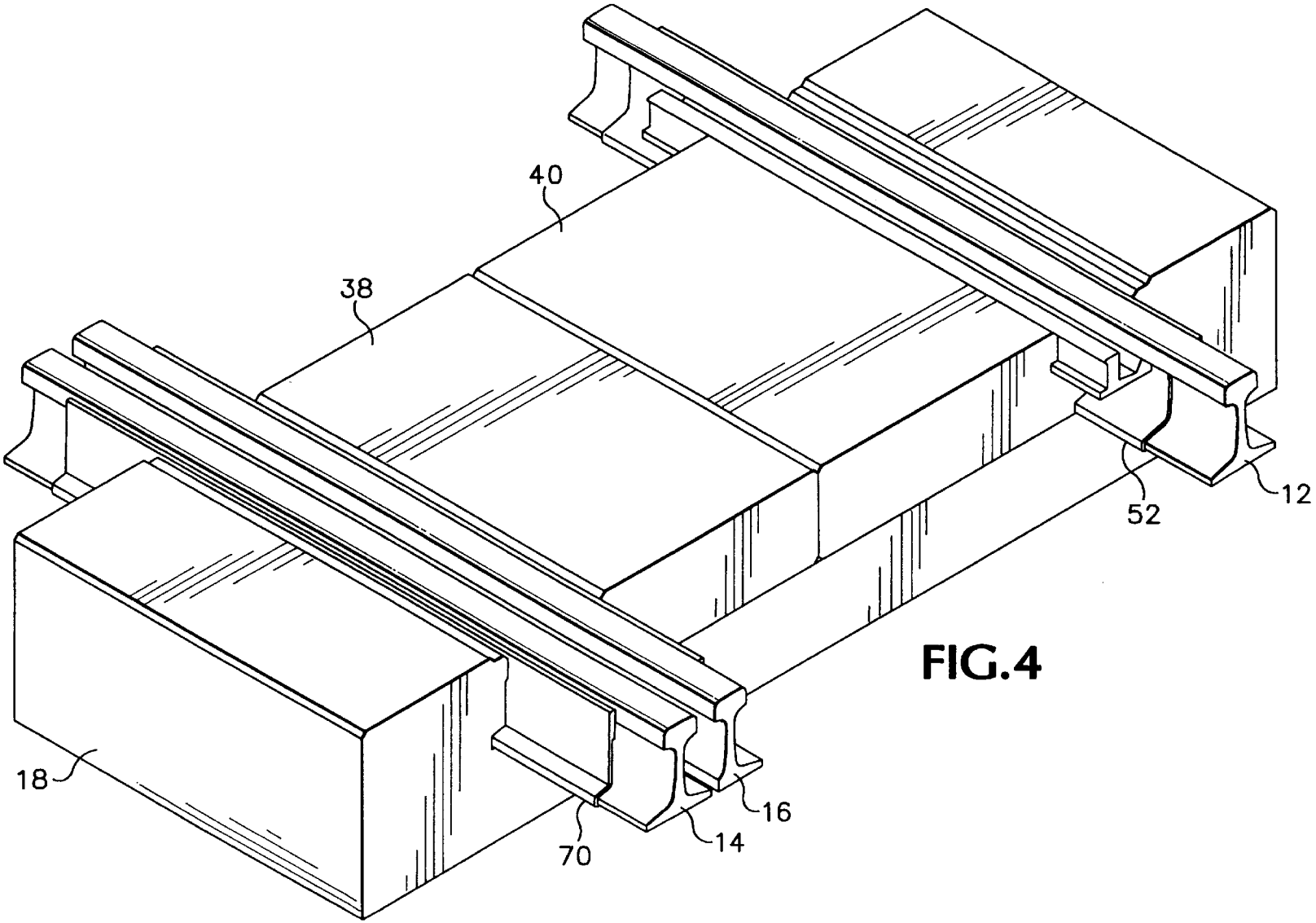
FIG. 4 is a perspective view of a partially completed railroad crossing in accordance with the present invention.

FIG. 4 is a perspective view of a partially completed railroad crossing according to the present invention. It should be noted that although a complete crossing is not shown, simple elastomeric boot 52 and wide elastomeric boot 70 extend in a single continuous piece across each base member in crossing 10, like base members 18, 20, 22, 24, 26, 28, and 30, as shown in FIG. 4. By doing so, simple boot 52 and wide boot 70 maintain rails 12 and 14 and restraining rail 16 electrically isolated from the precast concrete components which form the crossing.

Simple boot 52 is described in further detail in U.S. Pat. No. 5,464,152 to Wabnitz, incorporated herein by reference.

Of significant importance to the present invention is rail pair 13 shown enlarged in FIG. 3. Rail pair 13 comprises rail 14, restraining rail 16, center securing block 90, left securing block 92, and right securing block 94. Left, center, and right securing blocks 90, 92, and 94 are made of a rigid material preferably a hard metal like steel. Rail 14 and restraining rail 16 are held together by carriage rail bolt 86 secured by nut 88. Carriage rail bolt 86 traverses left securing block 92, rail 14, center securing block 90, restraining rail 16, and right securing block 94 and is terminated with nut 88 thereby fixing rail 14 to restraining rail 16 through center securing block 90. By doing so, rail 14 has additional rigidity which restricts the movement of the train or railcar wheel when a rail car or train travels across rail 12 and 14. The added rigidity is specially necessary on a curved crossing because rail pair 13 is located on the inside of the curve which receives additional centrifugal forces as the railcar or train travels through the crossing.

Restraining rail 16 is secured in place by the use of rail clip 80. Rail clip 80 is bolted to base member 18 by clip bolt 82. It should be noted that wide boot 70 is positioned between clip 80 and restraining rail 16 allowing clip 80 to be bolted to base member 18 without having to puncture or otherwise cut wide boot 70 thereby maintaining electrical isolation between base member 18, clip 80, and rail pair 13. Clip bolt 82 is threadably engaged in a commercially available anchor 84 which is cast into base member 18 when the same is made. Anchor 84 includes a threaded bore into which clip bolt shank 83 is threadably received for securing clip 80 to base member 18, thereby laterally fixing restraining rail 16. As shown in FIG. 3, center panel 38 is molded to form recess 85 which provides a space for clip 80 and clip bolt 82. Although not shown in FIG. 3, recess 85 extends across each center panel, like panels 38 and 29 of FIG. 1, thereby allowing clip assemblies, like clip 80 and clip bolt 82, to fix restraining rail 16 at predetermined lengths along crossing 10.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A curved grade crossing on a roadway intersected by railroad rails supported on ties, said curved grade crossing comprising:

a precast concrete base member formed with a central recess, said central recess having a first and second parallel walls formed to conform generally to an outer surface of a rail;

a first and a second precast concrete panels laid substantially abutting at first ends of each of first and second panels and substantially received within the central recess of said base member, said first and second panels forming a first recess between the first parallel wall of said base member and a second end of said first panel and forming a second recess between the second parallel wall of said base member and a second end of said second panel;

a first rail substantially received within the first recess;

a restraining rail substantially received within the first recess and laid adjacent to said first rail; and a second rail substantially received within the second recess and laid substantially parallel to said first rail.

2. The curved grade crossing of claim 1 wherein said restraining rail is removably attached to said first rail for providing said first rail with added rigidity.

3. The grade crossing of claim 1 including a first unitary boot encasing said first and restraining rails by covering substantially an outer surface of said first and restraining rails for electrically isolating the first rail from the base member and the first panel.

4. The grade crossing of claim 3 wherein said first unitary boot is formed from substantially planar elastomeric material molded to conform to a substantial portion of the outer surface of said first and restraining rails.

5. The grade crossing of claim 3 including a plurality of base members positioned end-to-end and wherein said first unitary boot comprises a single length boot which extends through all the base members in the crossing.

6. The grade crossing of claim 3 including a second unitary boot encasing said second rail by covering substantially an outer surface of said second rail for electrically isolating the second rail from the base member and the second panel.

7. The curved grade crossing of claim 1 wherein said base member and first and second panels together have a substantially trapezoidal shape which varies in proportion to a radius of curvature of the crossing.

8. The curved grade crossing of claim 7 including a plurality of trapezoidal base members and a corresponding plurality of trapezoidal first and second panels positioned end-to-end to form the curved crossing.

9. The curved grade crossing of claim 1 including a plurality of base members positioned end-to-end, each of said base members having a wedge shape having a taper, the taper varying according to the curvature of the crossing.

10. A curved grade crossing on a roadway intersected by railroad rails supported on teics, said grade crossing comprising:

a precast concrete base member having a substantially trapezoidal shape and formed with a central reccess, the trapezoidal shape of said base member having dimensions which vary according to a radius of curvature of the grade crossing;

a first precast concrete center panel having a substantially trapezoidal shape and received within the central recess, the trapezoidal shape of said first panel having dimensions which vary according to the radius of curvature of the grade crossing;

a second precast concrete center panel having a substantially trapezoidal shape and laid abutting said first center panel within the central recess, the trapezoidal shape of said second panel having dimensions which vary according to the radius of curvature of the grade crossing;

a first rail positioned between a first parallel wall on said base member and said first panel; and a second rail positioned between a second parallel wall on said base member and said second panel.

11. The curved grade crossing of claim 10 including a third rail removably attached to said first rail and laid adjacent to said first rail between the first parallel wall on said base member and said first panel.

12. The curved grade crossing of claim 11 wherein said third rail is a restraining rail and provides rigidity and lateral stability to said first rail.

13. The grade crossing of claim 11 including a first unitary boot substantially encasing said first and third rails for electrically isolating the first and third rails from the base member and the first panel.

14. The curved grade crossing of claim 13 wherein the first boot includes ribbed portions for electrically isolating the first and third rails from said base member and said first center panel.

15. A curved grade crossing on a roadway intersected by railroad rails supported on ties, said grade crossing comprising:

a precast concrete base member having a substantially trapezoidal shape and formed with a central recess, the trapezoidal shape of said base member having dimensions which vary according to a radius of curvature of the grade crossing;

a first precast concrete center panel having a substantially trapezoidal shape and received within the central recess, the trapezoidal shape of said first panel having dimensions which vary according to the radius of curvature of the grade crossing;

a second precast concrete center panel having a substantially trapezoidal shape and laid abutting said first center panel within the central recess, the trapezoidal shape of said second panel having dimensions which vary according to the radius of curvature of the grade crossing;

a first rail positioned between a first parallel wall on said base member and said first panel; and a second rail positioned between a second parallel wall on said base member and said second panel;

a third rail removably attached to said first rail and laid adjacent to said first rail between the first parallel wall on said base member and said first panel; and a first boot substantially encasing said first and third rails;

wherein the first boot includes ribbed portions for electrically isolating the first and third rails from said base member and said first center panel.

16. The curved grade crossing of claim 15 including a second boot substantially encasing said second rail and wherein said first and second boots are formed from substantially planar elastomeric material molded to conform to a substantial portion of the outer surface of said first, second, and third rails.

17. A method of making a precast curved grade crossing on a roadway intersected by railroad tracks supported on ties, the method comprising:

placing wet concrete into a substantially trapezoidal base member mold having dimensions which vary according to a radius of curvature of a curved crossing thereby forming a substantially trapezoidal base member having a central recess and dimensions which vary according to the radius of curvature of the curved crossing;

placing wet concrete into a substantially trapezoidal center panel mold having dimensions which vary according to the radius of curvature of the curved crossing thereby forming a substantially trapezoidal center panel having dimensions which vary according to the radius of curvature of the curved crossing;

so forming a plurality of base members and center panels;

laying a first and second center panels of the plurality of center panels in a central recess of one of said plurality of base members; and laying each of the plurality of said base members and the corresponding first and second center panels end-to-end to form the curved crossing.

18. The method of making a precast curved grade crossing of claim 17 including laying a first and a second rail substantially parallel to each other, the first rail positioned between a first opposed parallel wall of the central recess of the base member and the first center panel and the second rail positioned between a second opposed parallel wall of the central recess of the base member and the second center panel.

19. The method of making a precast curved grade crossing of claim 18 including laying a third rail adjacent to the first rail and fixedly attaching the third rail to the first rail.

20. The method of making a precast curved grade crossing of claim 19 further including providing an unitary boot formed from substantially planar elastomieric material molded to conform to a substantial portion of said first and third rails and encasing the first and third rail in the boot for electrically isolating the first and third rails from the base member and the first panel.

21. The method of making a curved precast grade crossing of claim 20 including extending the unitary boot to cover substantially all of an outer surface of a head portion of the first and third rails.

* * * * *